United States Patent [19]

Kussy et al.

[11] 4,088,973

[45] May 9, 1978

[54] UNITIZED COMBINATION STARTER

[75] Inventors: Frank W. Kussy, Haverford, Pa.; Bernard Dimarco, Bellefontaine, Ohio; Andrew J. Kralik, Marysville, Ohio; Keith T. Krueger, Bellefontaine, Ohio

[73] Assignee: Gould Inc., Rolling Meadows, Ill.

[21] Appl. No.: 681,243

[22] Filed: Apr. 28, 1976

[51] Int. Cl.[2] ..... H01H 73/00; H01H 83/00

[52] U.S. Cl. ..... 335/6; 335/42

[58] Field of Search ..... 335/6, 8, 42

[56] References Cited

U.S. PATENT DOCUMENTS

| | | | |
|---|---|---|---|
| 3,559,120 | 1/1971 | Myers | 335/42 |
| 3,987,382 | 10/1976 | Cataldo et al. | 335/6 |

*Primary Examiner*—Harold Broome

*Attorney, Agent, or Firm*—Ostrolenk, Faber, Gerb & Soffen

[57] ABSTRACT

A unitized combination motor starter is provided with a single insulated housing wherein a plurality of pole units are disposed in side-by-side relationship. The pole units are electrically connected in series with an electromagnetic contactor disposed within the insulated housing and located at one end of the pole units. A spring powered contact operating mechanism for the pole units is disposed on one side of the pole units. An overload sensing electromagnet coil, provided for each of the pole units, is positioned for removal and replacement after opening the front cover of the insulated housing.

12 Claims, 9 Drawing Figures

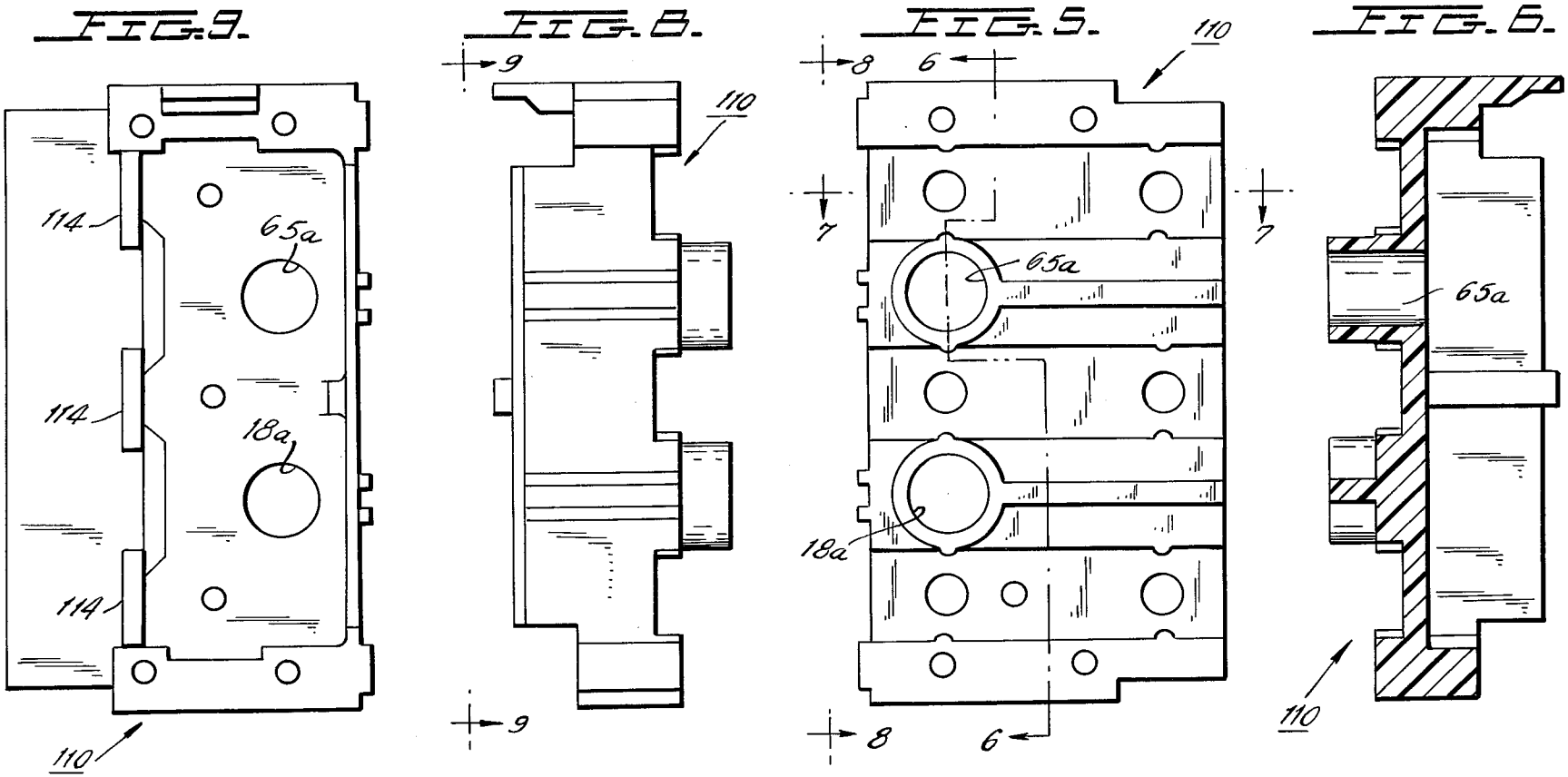
FIG. 6.
65a
110
FIG. 5.
110
65a
18a
6
7
8
FIG. 8.
110
9
FIG. 9.
65a
18a
114
110
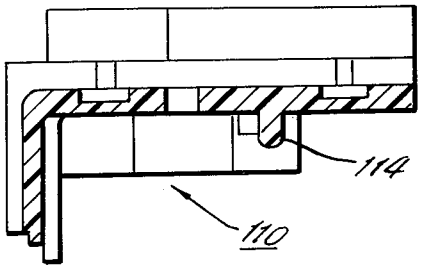
FIG. 7.
114
110

UNITIZED COMBINATION STARTER

This invention relates to motor starters in general and, more particularly relates to an improvement of the combination unit disclosed in the J. B. Cataldo et al. copending application Ser. No. 598,052, filed July 22, 1975, issued as U.S. Pat. No. 3,987,382 on Oct. 19, 1976, entitled "Unitized Motor Starter" and assigned to the assignee of the instant invention.

Prior to the teachings of the aforesaid application Ser. No. 598,052, so called combination motor starters often consisted of an electromagnetic contactor unit wired to a separate switch or circuit breaker. This type of apparatus was usually bulky and was often deficient from an electrical standpoint because the individual contactor and switch units available were not compatible to the extent necessary for achieving reliable operation under all conditions.

In the aforesaid co-pending application Ser. No. 598,052, there is disclosed a unitized motor starter including a single molded insulated housing divided into compartments for the current carrying elements of each pole unit in a multi-pole circuit breaker and a multi-pole contactor. Other compartments are provided in the housing for the circuit breaker operating mechanism and the electromagnet operator of the contactor. The compartments for the pole units are disposed adjacent to one another, the circuit breaker operating mechanism is disposed in a compartment on one side of the pole units, and the electromagnet operator of the contactor is disposed on the other side of the pole units. The calibration range of the circuit breaker is changeable by removing and replacing the sensing coils for the so-called instantaneous trip mechanism, with access to these coils being had at the rear of the starter.

In accordance with teachings of the instant invention, a unitized combination starter is constructed with a multi-pole circuit breaker and an electromagnetic contactor mounted at one end of the circuit breaker, and on the same base therewith. The circuit breaker operating mechanism is mounted to one side of the circuit breaker contact elements and the contactor operating mechanism is mounted behind the contactor contacts. Rating coils for the automatic trip means are removable and replaceable from the front of the combination unit after removing the front cover of the housing. Disposed in front of arc extinguishing means for the circuit breaker is a common trip bar which is operated by the overload sensing coils. This trip bar section of the housing is provided with a separate front cover disposed behind the cover of the housing. Conducting straps carried by the inner cover on its front surface are provided for serially connecting the overload sensing soils and the contactor contacts.

Accordingly, a primary object of the instant invention is to provide an improved construction for a unitized combination starter.

Another object is to provide a device of this type constructed to facilitate final assembly of parts.

A further object is to provide a device of this type having instantaneous trip coils that are accessible for removal and replacement when the front cover of the unit housing is removed.

These objects as well as other objects of this invention shall become readily apparent after reading the following description of the accompanying drawings in which:

FIG. 5 is a plan view of the auxiliary cover for the trip mechanism chamber.

FIGS. 6 and 7 are cross-sections taken through the respective lines 6—6 and 7—7 of FIG. 5 looking in the directions of respective arrows 6—6 and 7—7.

FIG. 8 is an end view of the auxiliary cover looking in the direction of arrows 8—8 of FIG. 5.

FIG. 9 is a rear view of the auxiliary cover looking in the direction of arrows 9—9 of FIG. 8.

Figure 4:
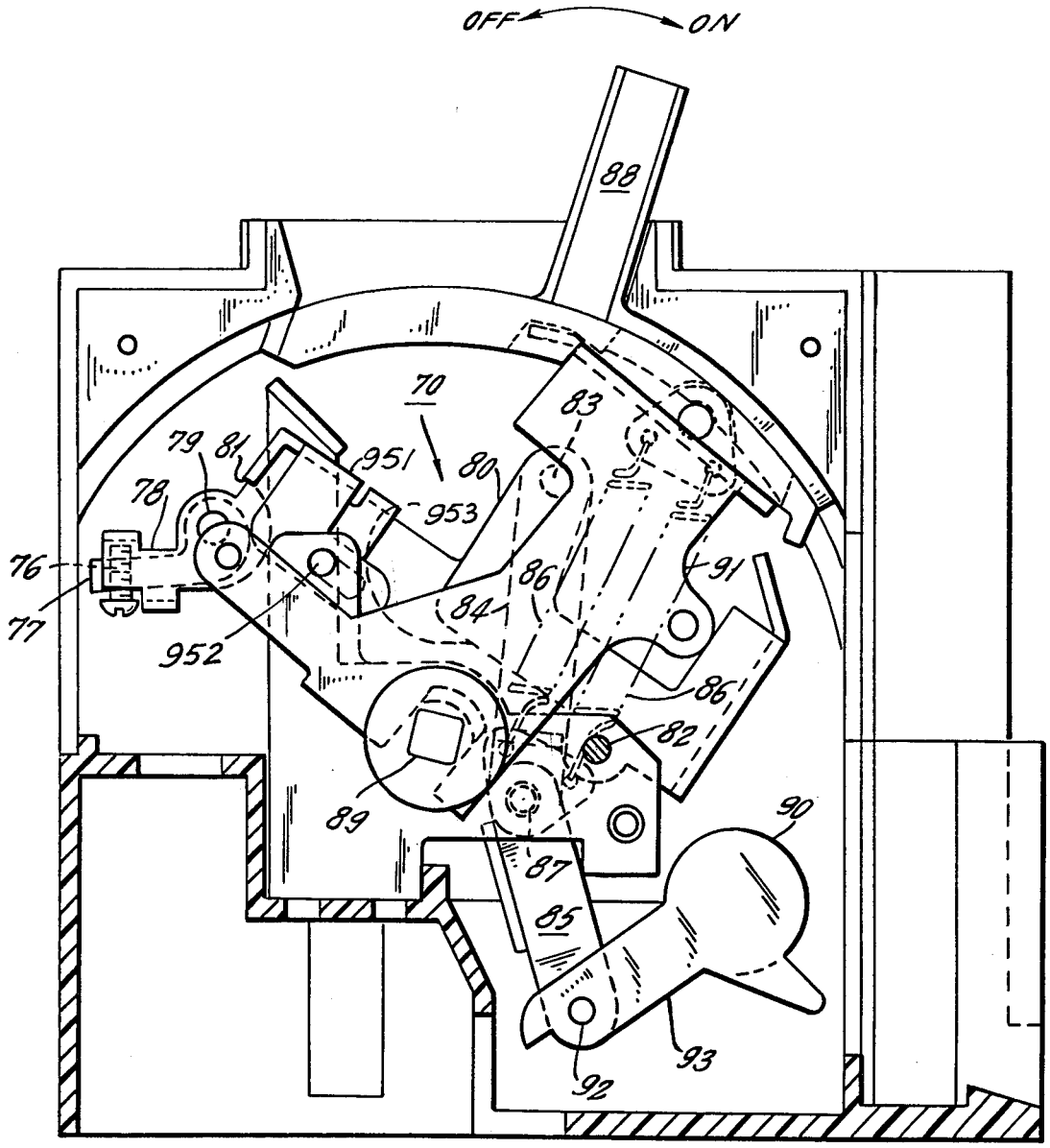
FIG. 4 is a cross-section taken through line 4—4 of FIG. 1 looking in the direction of arrows 4—4 and showing the elements of the circuit breaker manual operating mechanism in contact closed position.

Now referring to the Figures. Unitized combination motor starter 20 includes a molded insulating housing consisting of base 21 and removable shallow cover 22 secured in operative position by screws 19. Cover 22 includes longitudinally extending parallel ribs that mate with similar ribs 24, 25, 26 in base 21 to form elongated parallel compartments. Three of these compartments have current carrying elements identical to those illustrated in the right hand portion of FIG. 2, and constitute a pole of the three pole circuit breaker portion 59 of starter 20. Removable side cover 67 is provided for the compartment which encloses spring powered trip free contact operating mechanism 70 of FIG. 4.

Figure 2:
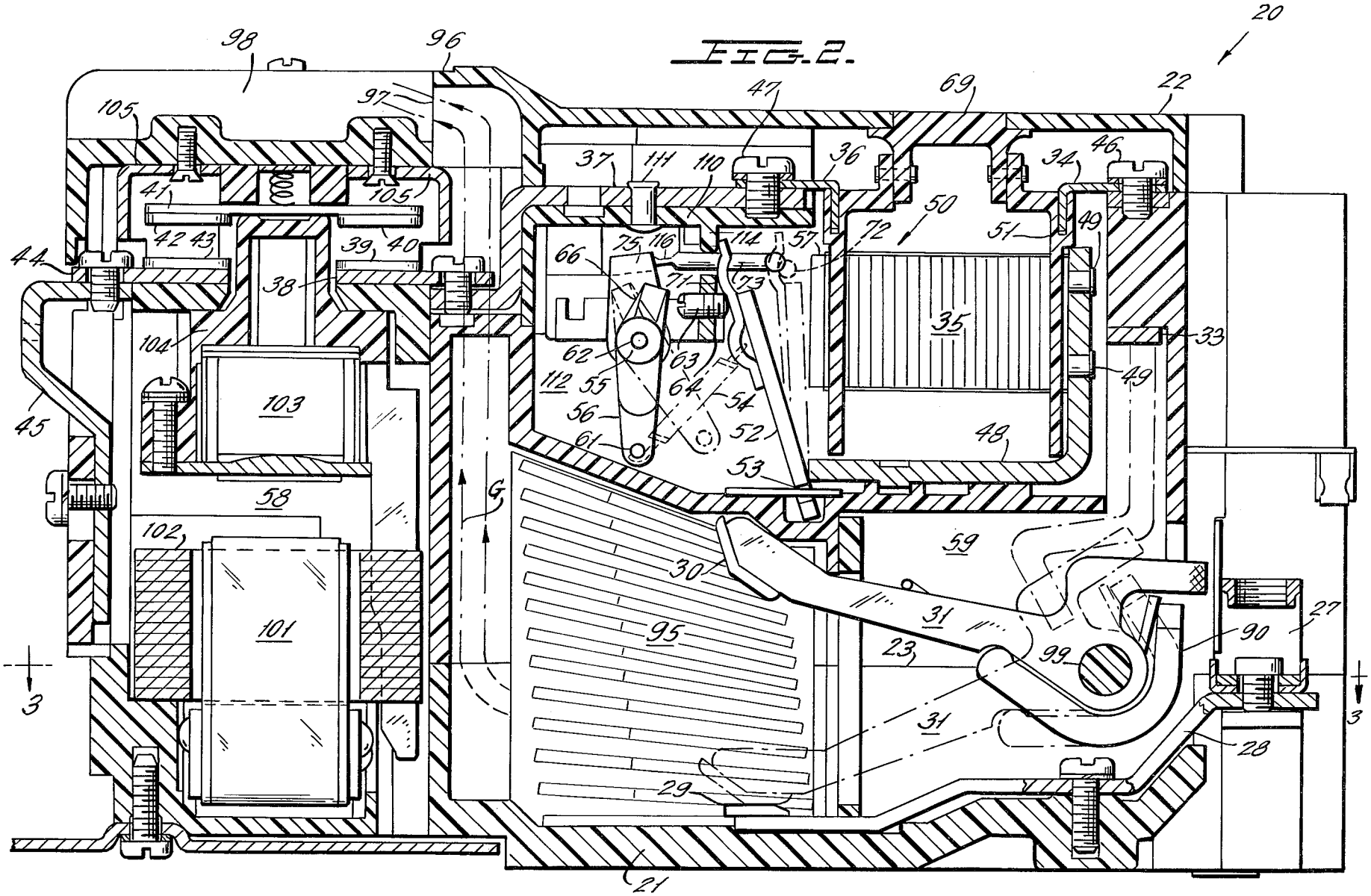
FIG. 2 is a cross-section taken through line 2—2 of FIG. 1 looking in the direction of arrows 2—2 and showing the elements of one pole unit.
Figure 3:
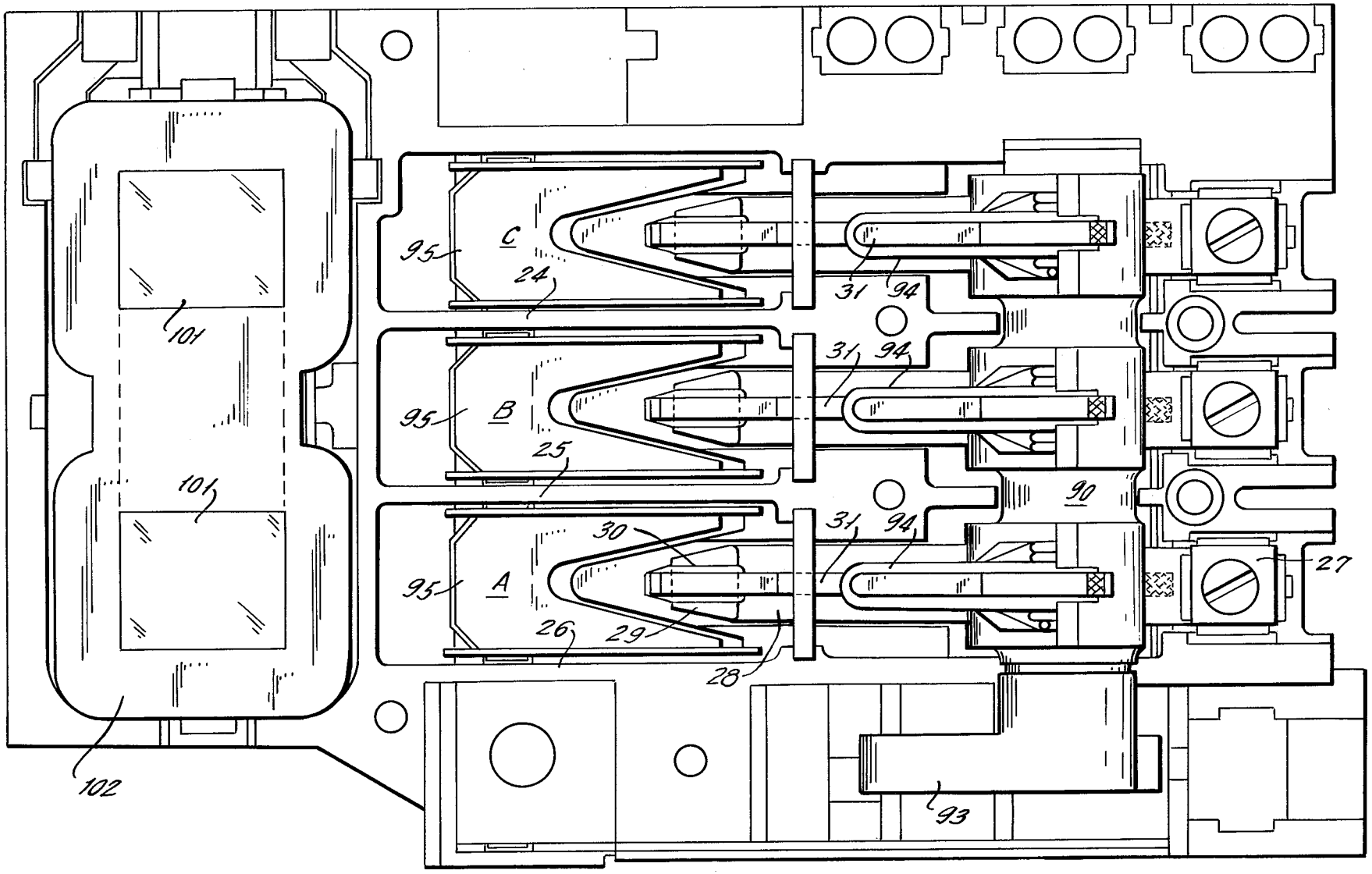
FIG. 3 is a cross-section taken through lines 3—3 of FIG. 2 with the circuit breaker contacts closed, looking in the direction of arrows 3—3.

The current carrying path for each pole A, B, C of starter 20 is identical so that only one of these paths shall be described with particular reference to FIG. 2. This current path includes wire grip 27 at one end of line terminal strap 28, strap 28, stationary contact 29 at the other end of strap 28, movable contact 30 at one end of contact arm 31, arm 31, flexible braid 32 at the other end of arm 31, U-shaped strap 33, coil terminal 34, coil 35, the other terminal 36 for coil 35, conducting straps 37 and 38, stationary contact 39 of electromagnetic contactor portion 58 of starter 20, movable contactor contact 40, conducting bridge 41, movable contactor contact 42, stationary contactor contact 43, conducting strap 44, and load terminal strap 45. The latter is constructed so as to be connectible directly to a load or to be connectible to a load through a conventional overload relay (not shown).

Figure 1:
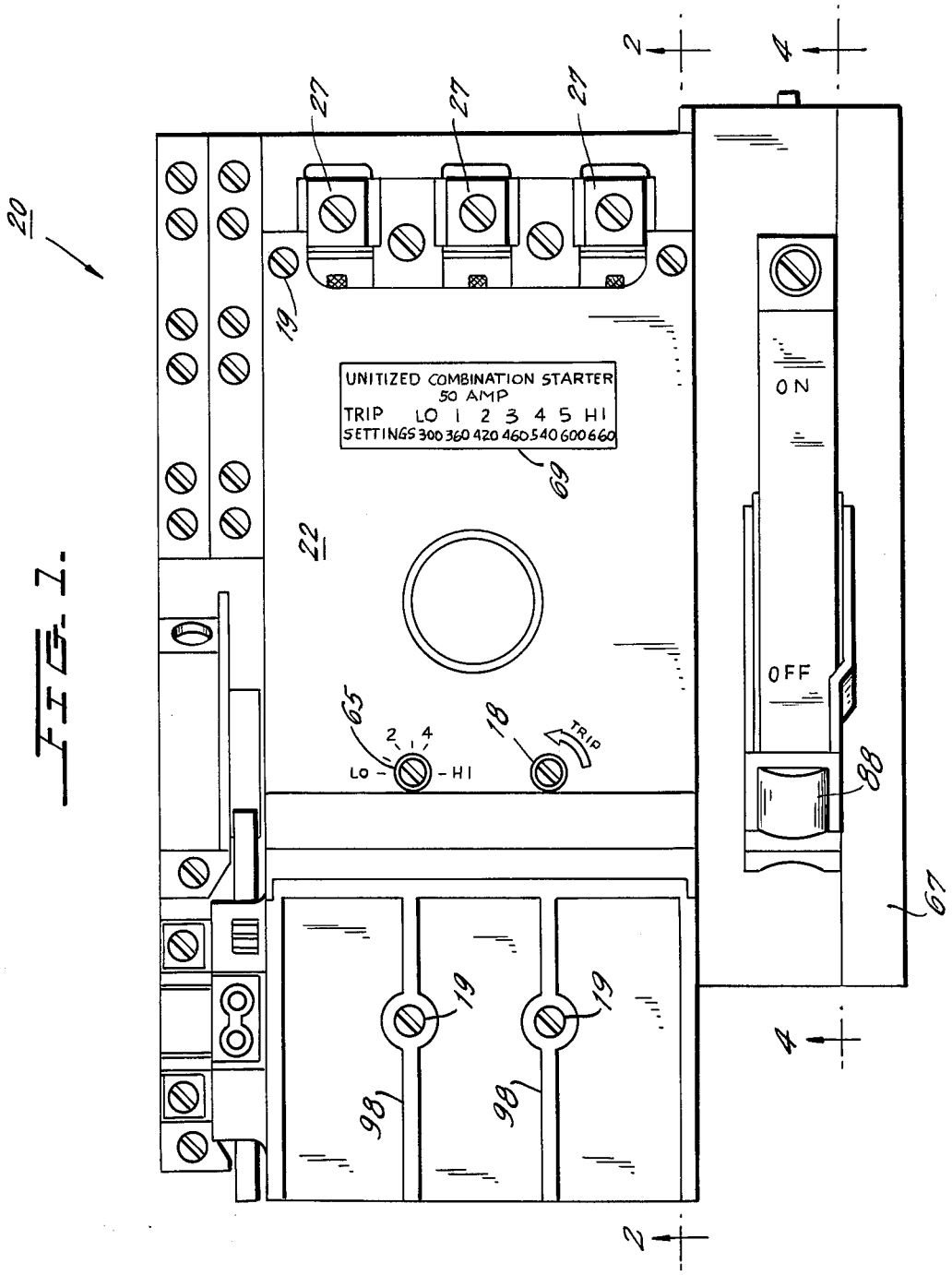
FIG. 1 is a plan view of a unitized combination motor starter constructed in accordance with teachings of the instant invention.

Coil 35 is part of circuit breaker calibrating assembly 50 removably and replaceable from the front of starter 20 after front cover 22 is removed. The calibrating assemblies 50 of all three poles may be individual units or they may be connected to a common insulating member 69 (FIG. 1) so that all three assemblies 50 must be removed as a unit.

Each subassembly 50 is electrically and mechanically secured in operative position by a pair of screws 46, 47 that are accessible when cover 22 is removed from base 21. Coil 35 is wound about bobbin 57 that surrounds one leg of stationary C-shaped magnetic frame 48. The latter is secured by rivets 49, 49 to insulator 51 having terminal 34 and bobbin 57 mounted thereto. The magnetic frame also includes movable armature 52 which is pivotally mounted at its lower end in the region indicated by reference numeral 53 so that the upper end of armature 52 may move toward and away from stationary frame portion 48. Coiled tension spring 54 is connected to pin formation 61 at the free edge of radial extension 56 on adjusting bar 55. The latter is pivoted on pins 62 so that spring 54 biases the upper end of armature 52 away from magnetic frame 48. The air gap adjustment between armature 52 and frame 48 is set by screw 63 which is threadably mounted to transverse member 64. A cam (not shown) at the rear of pivotable adjusting control 65 engages extension 66 of member 55 to adjust the tension on all three springs 54 without changing the air gaps between any of the armatures 52 and their associated stationary frame sections 48. Control 65 extends through and is journalled for movement within aperture 65*a* of auxiliary cover 110 (FIG. 5). Turn-to-trip control 18 extends through and is journalled for movement within aperture 18*a* of auxiliary cover 110. Both controls 65 and 18 are accessible for operation through apertures in main cover 22.

Upon the occurrence of predetermined fault current conditions the flux generated by current flowing in coil 35 attracts armature 52 to stationary frame 48 causing bifurcated armature extension 71 to engage enlarged formation 72 on transverse extension 73 of common tripper bar 75. This pivots the latter clockwise about an axis which coincides with axis 62 for adjusting bar 55 which causes screw 76 on tripper bar extension 77 to pivot latch member 78 in a clockwise or tripping direction about its pivot 79, thereby releasing latching point 81 of latch plate 951 on pivot 952 thereby releasing latching point 953 of cradle 80 so that the latter is free to pivot clockwise about pivot 82. As cradle 80 pivots counterclockwise, end 83 of upper toggle link 84 moves up and to the right with respect to FIG. 4 permitting coiled tension spring 86, connected between toggle knee 87 and manual operating handle 88, to collapse toggle 84, 85 and move handle 88 to the left. The latter is pivoted about center 89 through a connection between handle 88 and its rearward extension 91.

The lower end of lower toggle link 85 is pivotally connected at 92 to the free end of radial extension 93 of contact carrier 90. This causes carrier 90 to pivot clockwise with respect to FIG. 4 and by so doing moves the contact arms 31 of all three poles to the solid line or open circuit position of FIG. 2. It is noted that in the closed position of circuit breaker portion 59 an individual torsion spring 94, interposed between carrier 90 and movable contact arm 31, biases arm 31 counterclockwise about insulating rod 99 as a center and thereby generates contact pressure.

For each pole A, B, C an individual parallel plate arc chute 95 is provided to facilitate extinction of arcs drawn between circuit breaker contacts 29, 30 upon separation thereof. Arcing gases exiting from arc chute 95 at the left thereof with respect to FIG. 2 migrate forward as indicated by the dash lines G and are directed by hooded portion 96 of cover 22 to exit through opening 97 and flow to the left with respect to FIG. 2 in front of contactor section 58. External cover barriers 98 serve to prevent direct mixing of arcing gases from different poles at the instant these gases leave housing 21, 22 through exit openings 97.

The electrical and magnetic elements of contactor 58 are generally of conventional construction and include U-shaped magnetic yoke 101 whose arms are surrounded by portions of coil 102. When the latter is energized, armature 103 is attracted to yoke 101 and carries contact carrier 104 rearward. The latter mounts the bridging contacts 41 of all three poles so that contacts 41 move to their closed position wherein movable contacts 40, 42 engage the respective stationary contacts 39, 43. Steel elements 105 mounted to the inside of cover 22 are positioned in the regions of the contactor contacts 39, 40, 42, 43 whereby extinction of arcs drawn between these contacts upon separation thereof is facilitated through magnetic action.

Rivet 111 (FIG. 2) secures conducting strap 37 on the forward surface of insulating cover 110 of L-shaped cross-section. The latter forms the forward boundary for chamber 112 wherein common tripper bar 75, adjusting bar 55 and armatures 52 are disposed. After the removal of main cover 22, auxiliary cover 110 is removable for access to adjusting screws 63. The rear surface of cover 110 is provided with protrusions 114 which engage and guide movement of extension 73. The latter is flexibly mounted to trip bar 75 at resilient reduced cross-section area 116 which is constructed to bias extension 73 forward. It is noted that base 21 is a multipart unit having sections which mate along dividing line 23 so that the reduced diameter bearing portions of contact carrier 90 may be inserted and captured in operative positions.

For more detailed descriptions of certain elements illustrated in the drawings reference is made to one or more of the following co-pending U.S. Patent applications Ser. Nos. 681,245, 681,250, 681,253, 681,244, all filed on even date herewith.

Although a preferred embodiment of this invention has been described, many variations and modifications will now be apparent to those skilled in the art, and it is therefore preferred that the instant invention be limited not by the specific disclosure herein but only by the appending claims.

What is claimed is:

1. An electrical protective device including a multipole circuit breaker and a multipole electromagnetic contactor connected in electrical series with said circuit breaker, housing means including a base having said circuit breaker and said contactor mounted thereon with said contactor being at one end of said circuit breaker; said housing means including openable front cover means for said circuit breaker and said contactor; said circuit breaker comprising an overload sensing electromagnetic device including an individual operating coil for each pole of said circuit breaker; said circuit breaker also including a set of cooperating contacts for each pole thereof and a mechanism for operating said sets of cooperating contacts between open and closed positions; said mechanism including an operating handle having a forwardly extending manually engageable portion; each of said coils being accessible for removal and replacement from the front of said housing means upon opening of said cover means; said cover means when in operative position covering the front of said housing means blocking removal of said coils.

2. An electrical device as set forth in claim 1 in which each pole of the circuit breaker includes arc extinguishing means positioned to receive electric current arcs drawn between the contacts upon separation thereof, said arc extinguishing means being positioned behind said overload sensing electromagnetic device.

3. An electrical device as set forth in claim 2 in which the circuit breaker also includes a common trip bar extending into all of said poles for operation by said electromagnetic device when the latter detects a predetermined overload condition; said housing means including a section wherein said trip bar is located; said section having a removable front cover disposed behind said cover means; a conducting strap for each of said poles, said straps secured to the front surface of said front cover; each of straps providing a connecting point for one of said coils and another connecting point for a pole of the contactor.

4. An electrical device as set forth in claim 2 in which the said mechanism for operating said contact is mounted along a side of said circuit breaker; said contactor including additional contacts and an operating electromagnet connected to said additional contacts for selective operation thereof; said operating electromagnet being disposed directly behind said additional contacts.

5. An electrical protective device as set forth in claim 4 in which the contactor includes additional contact means and an electromagnet connected to said additional contact means for selective operation of the latter; said electromagnet being disposed directly behind said additional contact means; said overload sensing electromagnetic device being electrically connected in circuit between said circuit breaker and said contactor.

6. An electrical protective device as set forth in claim 1 in which the overload sensing electromagnetic device is electrically connected in circuit between said circuit breaker and said contactor.

7. An electrical protective device as set forth in claim 1 the overload sensing electromagnetic device also includes an individual magnetic frame operatively associated with an individual one of said coils each of said coils and a portion of said frame being accessible for removal and replacement from the front of said housing means upon opening of said cover means while other portions of said device remain mounted within said housing; said coils and said portions of said frames of all poles of said circuit breaker being parts of a single removable unit.

8. An electrical protective device including a multipole circuit breaker and a multipole electromagnetic contactor connected in electrical series with said circuit breaker, housing means including a base having said circuit breaker and said contactor mounted thereon with said contactor being at one end of said circuit breaker; said housing means including openable front cover means for said circuit breaker and said contactor; said circuit breaker comprising an overload sensing electromagnetic device including an individual operating coil for each pole of said circuit breaker, each of said coils being accessible for removal and replacement from the front of said housing means upon opening of said cover means; said circuit breaker also including a common trip bar extending into all of said poles for operation by said electromagnetic device when the latter detects a predetermined overload condition; said housing means including a section wherein said trip bar is located; said section having a removable front cover disposed behind said cover means.

9. An electrical device as set forth in claim 8 also including a conducting strap for each of said poles; said strap secured to the front surface of said front cover; each of straps providing a connecting point for one of said coils and another connecting point for a pole of the contactor.

10. An electrical device as set forth in claim 9 in which the housing means is provided with vent openings at said one end; said cover means at said one end constructed to direct gases which occur during opening of said circuit breaker, past said one end and along the forward surface of that portion of said cover means in front of said contactor.

11. An electrical protective device including a multipole circuit breaker, housing means including a base having said circuit breaker mounted thereon; said circuit breaker including a contact operating handle having a manually engageable portion positioned forward of said base; said housing means also including openable front cover means for said circuit breaker; said circuit breaker also including an overload sensing electromagnetic device comprising an individual magnetic frame and an associated operating coil for each pole of said circuit breaker; each of said coils and a portion of said frame being accessible for removal and replacement from the front of said housing means upon opening of said cover means while other portions of said device remain mounted with said housing; said coils and said portions of said frames of all poles of said circuit breaker being parts of a single removable unit.

12. An electrical protective device as set forth in claim 11 in which the removable unit includes a common insulating support to which the coils of all of said poles are secured.

* * * * *

UNITED STATES PATENT AND TRADEMARK OFFICE

CERTIFICATE OF CORRECTION

PATENT NO. : 4,088,973

DATED : May 9, 1978

INVENTOR(S) : F.W. Kussy, B. DiMarco, A.J. Kralik, K.T. Krueger

It is certified that error appears in the above-identified patent and that said Letters Patent are hereby corrected as shown below:

Column 1, line 54 - delete "soils" and substitute therefor --coils--

Column 5, line 32 - after "coils" insert --;--

Signed and Sealed this

*Twenty-fifth* Day of *September 1979*

[SEAL]

*Attest:*

*Attesting Officer*

LUTRELLE F. PARKER

*Acting Commissioner of Patents and Trademarks*